United States Patent [19]

Grawe et al.

[11] 4,317,414

[45] Mar. 2, 1982

[54] SEA-BOTTOM MINE

[75] Inventors: Helmut Grawe, Hamburg; Claus Petters, Brekendorf, both of Fed. Rep. of Germany

[73] Assignee: Messerschmitt-Bolkow-Blohm Gesellschaft mit beschrankter Haftung, Munich, Fed. Rep. of Germany

[21] Appl. No.: 703,140

[22] Filed: Jul. 2, 1976

[30] Foreign Application Priority Data

Jul. 9, 1975 [DE] Fed. Rep. of Germany ..... 2530616

[51] Int. Cl.[3] ..... F42B 22/00

[52] U.S. Cl. ..... 102/406

[58] Field of Search ..... 102/10, 11, 12, 13

[56] References Cited

U.S. PATENT DOCUMENTS 3,354,826 11/1967 Axelson et al. ..... 102/10

FOREIGN PATENT DOCUMENTS 1117838 6/1968 United Kingdom ..... 102/10

*Primary Examiner*—Charles T. Jordan

*Attorney, Agent, or Firm*—Toren, McGeady & Stanger

[57] ABSTRACT

A sea-bottom mine actuated by a remote-control device, includes at least one operational part and a plurality of explosive sections. While awaiting use, the operational part and explosive sections are kept in an elongated column-like storage arrangement with the operational part and explosive sections hinged or flexibly connected together. In the storage arrangement, the operational part and explosive sections can be releaseably locked together. When the mine is thrown into the sea, the operational part and explosive sections are displaced from the column-like storage arrangement and open out into a flat arrangement with the operational part and explosive sections still interconnected together.

10 Claims, 17 Drawing Figures

Fig.1
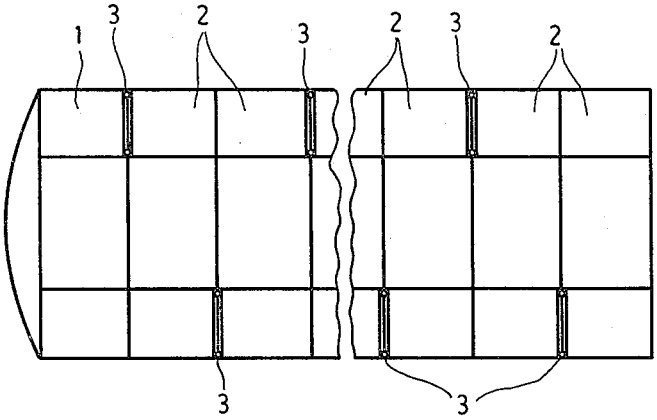
Fig.2
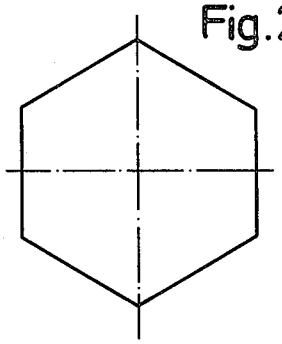
Fig.3
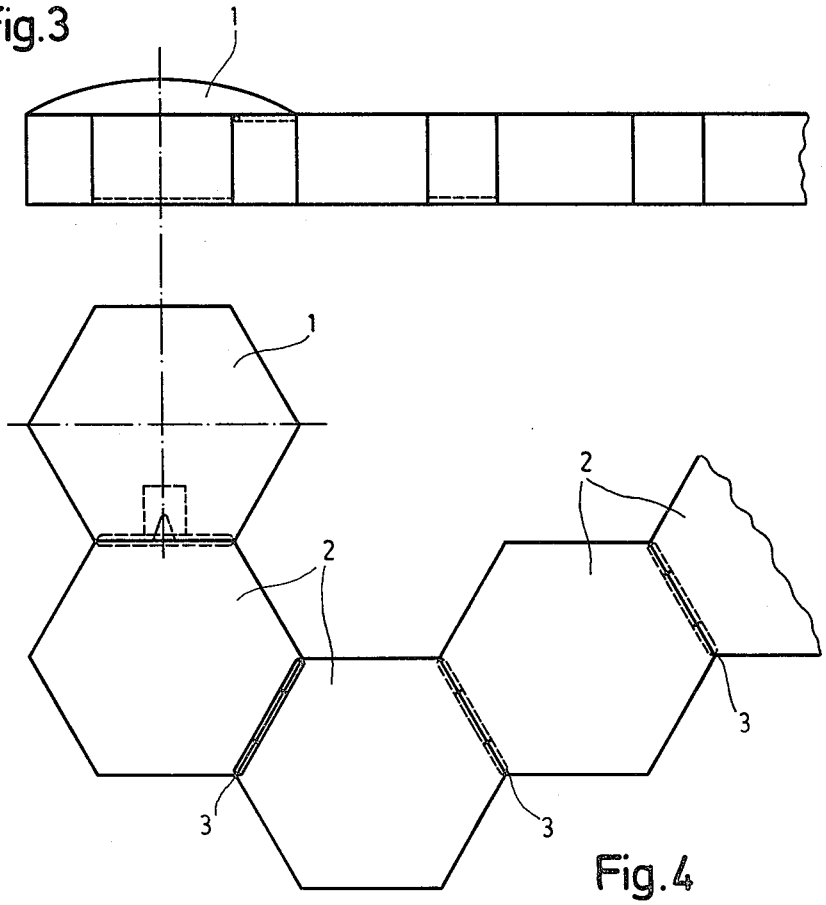
Fig.4

Fig.5
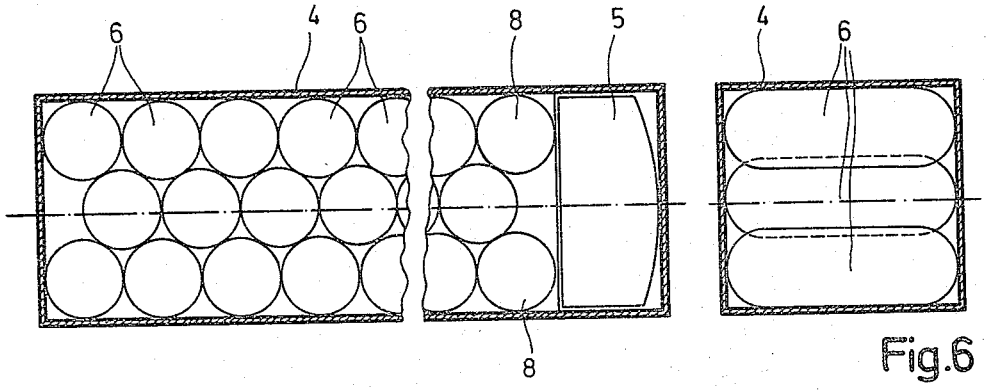
Fig.6
Fig.7
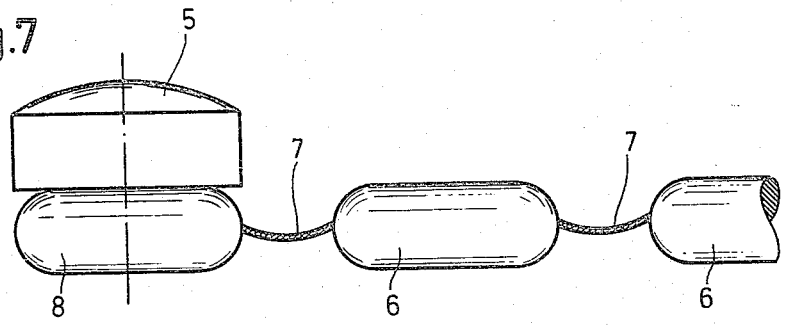
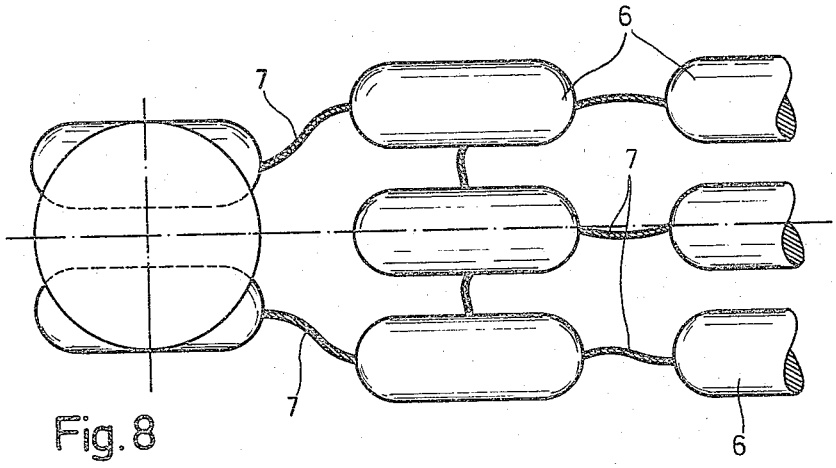
Fig.8

Fig.9
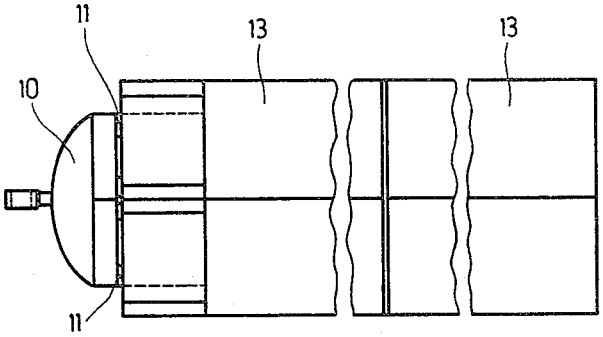
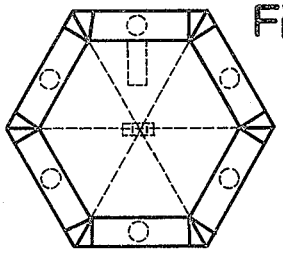
Fig.10
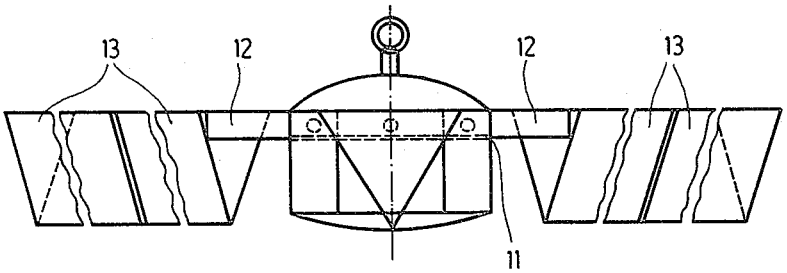
Fig.11
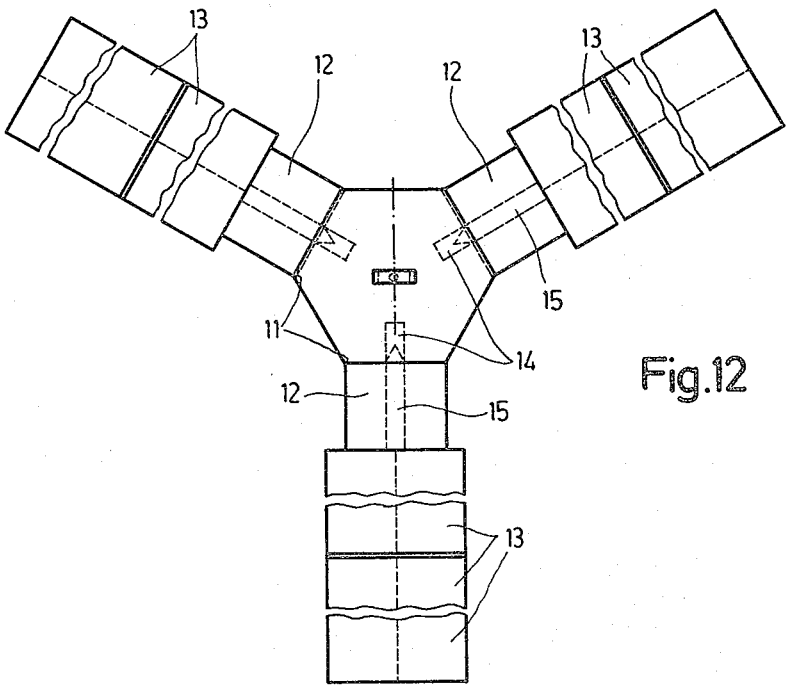
Fig.12

Fig.13
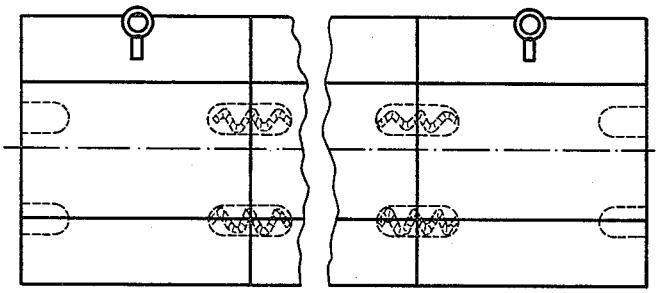
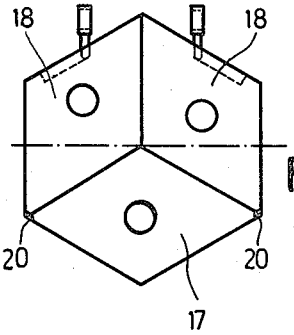
Fig.15
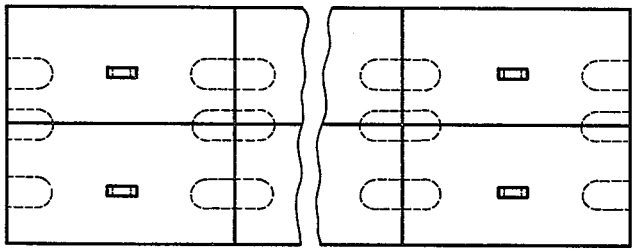
Fig.14
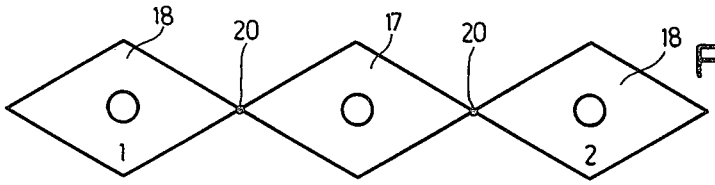
Fig.16
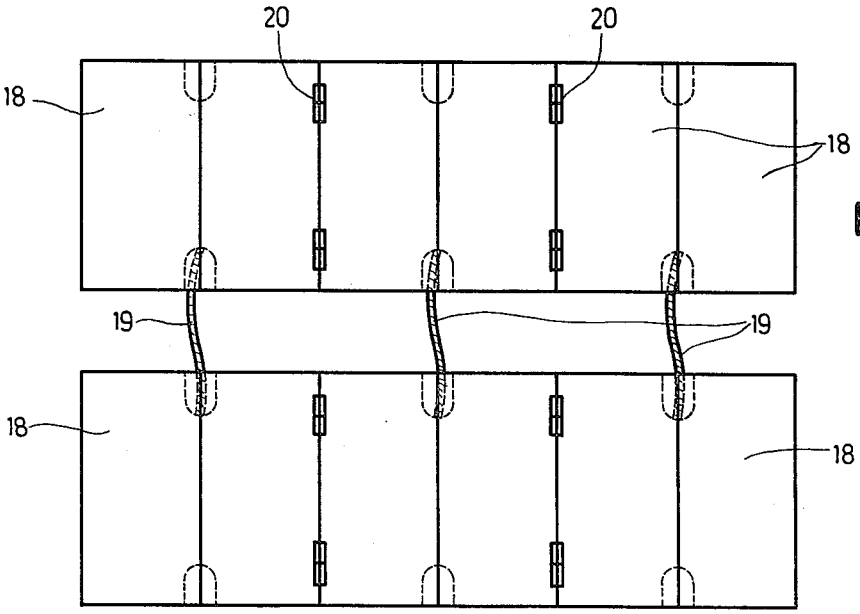
Fig.17

SEA-BOTTOM MINE

SUMMARY OF THE INVENTION

This invention relates to a sea-bottom mine with a remote-control ignition device.

The known sea-bottom mines mostly have the shapes of cylinders, the lengths of which are the multiples of their diameters. This shape has proved suitable with respect to storage and transportation systems. However, sea-bottom mines of such a shape, which are laid on the bottom of the sea, can be seen from far away and thus form an object for mine sweeping actions of the enemy, in particular when the mines stick vertically in the mud.

It is the objective of the invention to create a sea-bottom mine which—unlike known mine types—can be localised and swept with difficulty only.

According to the invention this is achieved by the variable geometry of the mine permitting the mine to lie as flat as possible on the bottom of the sea.

This invention will now be described by way of example with reference to the drawings, in which:

FIG. 1 is the view of a sea-bottom mine consisting of hexagonal sections,

FIG. 2 is the lateral view of FIG. 1,

FIG. 3 is the view of a sea-bottom mine according to FIG. 1 after laying, FIG. 4 is the plan view of the laid sea-bottom mine according to FIG. 3, FIG. 5 is a sea-bottom mine consisting of cylindrical sections, FIG. 6 is the lateral view of the mine according to FIG. 5, FIG. 7 is the view of a laid mine according to FIG. 6, FIG. 8 is the plan view of the laid sea-bottom mine according to FIG. 7, FIG. 9 is the view of a star-shaped sea-bottom mine, FIG. 10 is the lateral view of the mine according to FIG. 9, FIG. 11 is the view of a laid sea-bottom mine according to FIG. 10, FIG. 12 is the plan view of the laid sea-bottom mine according to FIG. 10, FIG. 13 is the view of a sea-bottom mine consisting of rhombic sections, FIG. 14 is the plan view of the mine according to FIG. 13, FIG. 15 is the lateral view of the mine according to FIG. 13, FIG. 16 is the view of a laid sea-bottom mine according to FIG. 13, FIG. 17 is the plan view of the laid sea-bottom mine according to FIG. 16.

DETAILED DESCRIPTION OF THE INVENTION

A preferred embodiment of the sea-bottom mine according to the invention is shown in FIG. 1 with the operational part 1, the explosive sections 2, and the hinges 3. The hexagonal shape is shown in the lateral view of FIG. 2. This shape increases the safety when handling the mines, because it can prevent the mines from rolling away. The mine is brought into the configuration according to FIG. 1 for storage and transportation. Locking mechanisms, which are not shown here, protect the explosive sections from falling apart. When laying the mine, the locking mechanisms are released in order that the individual explosive sections can unfold. A suitable weight distribution makes the mine assume the configuration of FIG. 3 in the water while sinking down onto the bottom of the sea. This is also the final position of the mine on the bottom of the sea. FIG. 4 shows a plan view of the laid sea-bottom mine. The hinges 3 are designed in such a way that the explosive sections can easily be connected to each other or separated without needing any tools. It is due to this fact that mines with different explosive charges can be combined. Moreover, operational parts and explosive sections can be stored separately. Ignition is accomplished by means of a shaped charge suitably fitted in the operational part.

Another embodiment of the invention is shown in FIG. 5. Explosive sections 6 and operational part 5 are accommodated in a square container 4. The square container—see lateral view in FIG. 6—can be piled in an optimum way. The container is thrown overboard and releases the mine in the water. After the mine leaves its container, said container becomes unstable and collapses on the bottom of the sea. The individual parts of the mine are held together by means of flexible connections 7. A suitable weight distribution makes the mine sink to the bottom of the sea in the configuration according to FIG. 7 and makes it thus assume its final position on the bottom of the sea. FIG. 8 shows a plan view of the laid sea-bottom mine. Ignition is accomplished by means of a shaped charge fitted in the operational part. A detachable connection between operational part 5 and adjoining explosive sections 8 permits separate storage of the operational part in this case, too.

The flexible connections 7 can be mounted without needing tools.

FIG. 9 shows still another embodiment of the invention. To the hexagonal operational part 10 on the hinges 11, which can be mounted without using tools, there are linked transition pieces 12, to which are mounted—also without using tools— the triangular prismatic explosive sections 13. After throwing, the columns formed by explosive sections 13 unfold and form a configuration according to FIG. 11. This configuration is also maintained by the mine when lying on the bottom of the sea. FIG. 12 shows a plan view of this star-shaped mine. For the sake of simplicity only three of the existing six arms are shown. Ignition is accomplished by means of shaped charges 14 and of perforation charges 15.

FIG. 13 shows still another embodiment of the invention. In the case of this mine, operational part 17 and explosive sections 18 have the shape of rhombic prisms. The mine is stored and transported in the configuration according to FIGS. 13, 14, and 15. The individual elements are held together by means of locking devices which are not shown here and which are released before throwing the mine. After throwing, sticking together is ensured by flexible connections 19 and hinges 20. On the bottom of the sea the mine assumes the configuration according to FIGS. 16 and 17. Ignition is accomplished by means of shaped charges. Depending on the purpose, mines of different numbers of explosive sections can be assembled without using tools. Separate storage of the operational parts is possible in this case, too.

What we claim is:

1. A sea-bottom mine such as is actuated by a remote-control ignition device, comprising at least one operational part and a plurality of explosive sections, means for interconnecting said operational part to at least one said explosive section and for interconnecting said explosive sections so that said operational part and explosive sections can be combined together in an elongated column-like storage arrangement and when thrown into a body of water, said operational part and said explosive sections become displaced from the column-like storage arrangement and move relative to one another so that said operational part and explosive sections remain interconnected and extend from one another in a direction transverse to the elongated direction of the column-like storage arrangement and rest on the bottom of the body of water.

2. A sea-bottom mine, as set forth in claim 1, wherein said operational part and said explosive sections have a hexagonal shape transversely of the elongated direction of the column-like storage arrangement, releaseable locking means securing said operational part and explosive sections together in the column-like storage arrangement, said means for interconnecting said operational part and said explosive sections comprising hinges interconnecting adjacent ones of said operational part and explosive sections in the column-like storage arrangement so that when said operational part and explosive sections are displaced from the column-like storage arrangement, they assume a flat arrangement having a height equal to the dimension of one said explosive section measured in the elongated direction of the column-like storage arrangement.

3. A sea-bottom mine, as set forth in claim 1, wherein said means for interconnecting said operational part and explosive sections comprises flexible connections each extending between said operational part and an adjacent one of said explosive sections or adjacent said explosive section, said explosive sections having an elongated cylindrical shape, an elongated cylinder for housing said operational part and explosive sections in the column-like storage arrangement and said operational part and explosive sections arranged to be displaced from said container when the mine is thrown into a body of water.

4. A sea-bottom mine, as set forth in claim 3, wherein said container has a square cross-section transverse of its elongated direction, and in the column-like storage arrangement in said container the elongated dimension of said cylindrically shaped explosive sections extends transverse to the elongated direction of said container.

5. A sea-bottom mine, as set forth in claim 4, wherein said operational part has a cylindrical shape in the direction extending transversely of the elongated direction of said container.

6. A sea-bottom mine, as set forth in claim 3, wherein said flexible connection interconnects said explosive sections together so that in the arrangement displaced from the column-like storage arrangement in said container said explosive sections are arranged in three rows extending from said operational part with said explosive sections in adjacent rows being interconnected by said flexible connections.

7. A sea-bottom mine, as set forth in claim 3, wherein said container being collapsible when said operational part and explosive sections are displaced from it so that said container collapses on the bottom after it is thrown into the body of water.

8. A sea-bottom mine, as set forth in claim 1, wherein said operational part in the direction transverse to the elongated direction of the column-like storage arrangement has a hexagonal shape with lateral surfaces extending in the elongated direction of the column-like storage arrangement, and a serially arranged row of said explosive sections interconnected to each of the lateral surfaces of said operational part so that when displaced from the column-like storage arrangement said operational part and explosive sections form a flat star-like arrangement with each point of the star-like arrangement comprising one of said rows of said explosive sections.

9. A sea-bottom mine, as set forth in claim 8, wherein said means for interconnecting said operational part and explosive sections are hinges.

10. A sea-bottom mine, as set forth in claim 1, wherein the column-like storage arrangement has a hexagonal shape transverse to its elongated direction, and said column-like storage arrangement is made up of a plurality of levels with each level composed of one said operational part having the shape of a rhombic prism and two said explosive sections having the shape of a rhombic prism similar to that of said operational part, said means for interconnecting said operational part and explosive sections comprises hinges interconnecting said operational parts in adjacent levels and aligned in the elongated direction of the column-like storage arrangement and interconnecting said explosive sections in adjacent levels and aligned in the elongated direction of the column-like storage arrangement, and flexible conections for interconnecting laterally adjacent ones of said operational parts and explosive sections.

* * * * *